US012569050B2

(12) United States Patent
Zheng et al.

(10) Patent No.: US 12,569,050 B2
(45) Date of Patent: Mar. 10, 2026

(54) APPLICATOR HEAD FOR APPLYING A COSMETIC PRODUCT

(71) Applicant: APR Beauty Group Inc, Toronto (CA)

(72) Inventors: Min-Yan Zheng, Richmond Hill (CA); Feng-Ying Fu, Markham (CA); Jun Shen, Lighthouse Point, FL (US)

(73) Assignee: APR Beauty Group Inc., Richmond Hill (CA)

( * ) Notice: Subject to any disclaimer, the term of this patent is extended or adjusted under 35 U.S.C. 154(b) by 581 days.

(21) Appl. No.: 18/061,569

(22) Filed: Dec. 5, 2022

(65) Prior Publication Data

US 2024/0180314 A1 Jun. 6, 2024

(51) Int. Cl.
*A45D 34/04* (2006.01)
*A45D 34/00* (2006.01)

(52) U.S. Cl.
CPC ..... *A45D 34/04* (2013.01); *A45D 2034/005* (2013.01)

(58) Field of Classification Search
CPC ..... A45D 40/265; A45D 34/042; A45D 34/04
See application file for complete search history.

(56) References Cited

U.S. PATENT DOCUMENTS 1,996,897 A * 4/1935 Blinn ..... B65D 51/32 604/289
2,007,245 A * 7/1935 Gimonet ..... A45D 40/262 D19/907
2,099,030 A * 11/1937 Morrison ..... B44D 2/00 132/320
2,231,197 A * 2/1941 Scioscia ..... B65D 47/18 401/128
D197,107 S * 12/1963 Forgue ..... D28/7
3,237,630 A * 3/1966 Politzer ..... A45D 40/265 401/262
6,067,997 A * 5/2000 Gueret ..... A46B 9/021 132/218
6,070,598 A * 6/2000 Gueret ..... A45D 40/265 132/320
7,866,327 B1 * 1/2011 Gueret ..... A46B 9/021 132/218
9,468,280 B2 * 10/2016 Uehara ..... A45D 34/045
9,955,770 B2 * 5/2018 Pires ..... A45D 34/04
2005/0217691 A1 * 10/2005 Petit ..... A46B 9/021 132/320

(Continued)

*Primary Examiner* — Nicholas D Lucchesi
*Assistant Examiner* — Jennifer Gill
(74) *Attorney, Agent, or Firm* — Jason L DeFrancesco

(57) ABSTRACT

An applicator head for applying a product including a cosmetic, care, or pharmaceutical product onto the keratinous substrate. The applicator head includes an applying member elongated along a central longitudinal axis. The applying member includes a front face, a rear face opposing the front face, a left face, and a right face opposing the left face. The applying member has an axial zigzag groove extending along a length of the applying member on at least one of the front face and the rear face of the applying member. The axial zigzag groove has vertices on both side of the central longitudinal axis of the applying member. Further, the applying member includes side grooves disposed on each side of the axial zigzag groove. The axial zigzag groove and the side grooves outline beads on an outer surface of the applying member.

15 Claims, 6 Drawing Sheets

(56) References Cited

U.S. PATENT DOCUMENTS

| | | | | |
|---|---|---|---|---|
| 2007/0181143 | A1* | 8/2007 | Montoli | A45D 40/262<br>132/320 |
| 2010/0240003 | A1* | 9/2010 | Fritze | A61C 19/063<br>433/80 |
| 2015/0117929 | A1* | 4/2015 | Schreiber | A46B 15/0055<br>401/25 |
| 2015/0374099 | A1* | 12/2015 | Pires | A45D 33/36<br>427/463 |
| 2019/0000222 | A1* | 1/2019 | Balestrini | A45D 34/046 |
| 2019/0298049 | A1* | 10/2019 | Castex | B29C 64/153 |
| 2022/0265028 | A1* | 8/2022 | Zheng | A45D 34/04 |
| 2023/0172338 | A1* | 6/2023 | Jacob | A45D 34/045<br>132/317 |

* cited by examiner

APPLICATOR HEAD FOR APPLYING A COSMETIC PRODUCT

BACKGROUND

Field

The present disclosure generally relates to an applicator head for applying a product including a cosmetic, care, or pharmaceutical product, onto a keratinous substrate such as skin, lips, under eyes, eyelids, cheeks, nails, and lips.

Description of the Related Art

Cosmetic applicators such as dip or wand applicators are known in the cosmetic industry. Cosmetic packages often include applicators for dispensing a particular cosmetic contained in the package reservoir. The cosmetic applicator generally includes a stem with a cap at one end and an applicator head in the form of a brush, spatula, or other applicator structure suitable for applying a cosmetic or a care product including viscous cosmetics, lip gloss, lip color, wound care, under-eye cosmetics, pharmaceutical and like products.

The conventional applicators, the applicator surface has to be dipped into cosmetic bulk several times in a repeated manner to complete the entire application process. Thus, the applicator surface capable of holding a considerable amount of cosmetic liquid is required. Further, an applicator that also provides the massaging function along with the cosmetic application is desirable.

US20050217691A1 discloses an applicator with varying shape across the entire length of the applicator head. Disclosed applicator includes a support and a plurality of radial discontinuities fixed to the support. The plurality of radial discontinuities forms a plurality of cavities offering high retention of the cosmetic product and a high contact surface with the product and application surface. In such applicators, the cavities formed on the surface of applicator head may store a large amount of cosmetic product that may not be available for easy application. So an applicator head with improved retention and dispensing of a cosmetic product is required.

Thus, an applicator head is needed which can not only hold a sufficient amount of cosmetic product but also provide a large surface for a smooth application of the cosmetic product on a keratinous surface.

SUMMARY

It is an object of the present disclosure to provide a cosmetic package that can be easily configured to contain a cosmetic product and an applicator head.

It is an object of the present disclosure to provide an applicator head that can apply a cosmetic product, care, or pharmaceuticals, or like products onto a keratinous surface such as lips, skin, under-eye, and cheeks, particularly lips. Further, the product can be a liquid, viscous or semi-solid product.

It is a further object to provide an applicator head that can apply a larger amount of cosmetic product without the need to re-dipping the applicator into the cosmetics supply occasionally, wherein the applicator head is configured in a simple and functionally reliable manner.

It is yet another object of the present disclosure to provide an applicator head that offers a comparatively large surface area, very simple to use, economical to manufacture.

Accordingly, there is provided an applicator head according to a first embodiment of the present disclosure. The applicator head comprises an applying member at its distal portion and a shank member at its proximal portion. The applying member of the applicator head is configured to apply the product including a cosmetic or care product. The applying member includes a front face, a rear face opposing the front face, a left face, and a right face opposing the left face. The applying member has an axial zigzag groove extending along the applying member on both the front face and the rear face of the applying member. The axial zigzag groove is located at the middle position of each of the front face and the rear face. The applying member, when seen from the front face, has an axial zigzag groove with vertices on both sides of the longitudinal axis of the applying member. Further, the applying member includes multiple side grooves disposed on each side of the axial zigzag groove. Each of the side grooves extends from the vertices of the axial zigzag groove of the front face to the corresponding vertices of the axial zigzag groove on the rear face of the applying member.

Throughout this specification, the terms "comprise," "comprises," "comprising" and the like, shall consistently mean that a collection of objects is not limited to those objects specifically recited.

According to an aspect of the present disclosure, the applying member is elongated along a central longitudinal axis. The applying member has a distal end and a proximal end that are opposite relative to the central longitudinal axis and are separated, along said central longitudinal axis, by a distance. Wherein, said distance defines the length of the applying member and is, for example, between 14 mm and 20 mm.

According to an aspect of the present disclosure, an outer surface of the applying member is contoured with multiple beads to resemble a braid. The multiple beads are contoured on the applying member and arranged in a manner to form a braid-like pattern on the front face and the rear face of the applying member. Particularly, the pattern formed by the arrangement of the multiple beads resembles a braid pattern formed by interlacing two or more strands. In a preferred embodiment, the applying member includes six beads that are convex structures with convex outer surfaces. Further, each of the six beads is non-spherical that is inclined with respect to the center longitudinal axis of the applying member.

According to an aspect of the present disclosure, the applying member when seen from the front face includes three left side beads located on the left side of the central longitudinal axis and three right side beads located on the right side of the central longitudinal axis. Each of the left side beads extends to the front face, the rear face, and the left face of the applying member. Similarly, each of the right side beads extends to the front face, the rear face, and the right face.

According to another aspect of the present disclosure, the left face of the applying member is defined by portions of the outer surfaces of the three left side beads. The right face of the applying member is defined by portions of the outer surfaces of the three right side beads. The left face and the right face thus have wavy curved surfaces along a length of the applying member due to the convex nature of the corresponding three left and the right side beads.

According to another aspect of the present disclosure, the applying member, when seen from the front face, has the three left side beads that incline upward from a left to a right direction and towards the center longitudinal axis of the applying member. The applying member, when seen from the front face, has the three right side beads that incline upward from the right to the left direction and toward the center longitudinal axis of the applying member. Each of the beads of the applying member has an elongated structure having a major axis and a minor axis.

According to yet another aspect of the present disclosure, the side grooves of the applying member meet the axial zigzag grooves at the vertices. Each side groove joins a vertex of the axial zigzag groove on the front face to a corresponding vertex of the axial zigzag groove on the rear face of the applying member. More particularly, each side groove extends in a peripheral direction from one of the vertices of the axial zigzag groove from the front face to the rear face to a corresponding vertex of the axial zigzag groove on the rear face of the applying member. Thereby, the applying member is divided into multiple connected beads by the axial zigzag grooves and multiple side grooves. In other words, the multiple side grooves and the axial zigzag grooves divide the applying member into a structure of multiple connected beads.

According to yet another aspect of the present disclosure, a plane passing through the central longitudinal axis of the applying member orthogonally to the front and the rear face divides the applying member asymmetrically into a left side part and a right side part when seen from the front face of the applying member. The vertices of the axial zigzag grooves that lie on the left side of the applying member are left vertices and those that lie on the right side of the applying member are right vertices. Similarly, the side grooves that extend on the left side of the applying member are left side grooves and the side grooves that extend on the right side of the applying member are right side grooves.

According to yet another aspect of the present disclosure, when the applying member is seen from the front face to the rear face, the left side grooves extend from alternate zigzag vertices, i.e. left side vertices of the front face to the corresponding left side vertices on the rear face. When the applying member is seen from the front face to the rear face, right side grooves extend from alternate zigzag vertices, i.e. right vertices of the front face to corresponding right vertices on the rear face of the applying member. All of the left and right side grooves are inclined, and the left side grooves and the right side grooves are inclined in opposite directions.

According to yet another aspect of the present disclosure, the axial zigzag grooves and the left side grooves divide the applying member into a row of axially arranged left side beads. The axial zigzag groove and the right side grooves divide the applying member into a row of axially arranged right side beads. The side grooves and axial zigzag grooves function to retain some amount of the cosmetic product therein in order to improve the product load on the applying member. Further, side grooves interconnect the two axial zigzag grooves forming channels that extend from the front face to the rear face of the applying member. The side grooves are inclined at an angle selected from a range of 85 to 65 degrees with respect to the central longitudinal axis of the applying member.

The axial zigzag and side grooves of the applying member are interconnected on the outer surface of the applying member. Thus, the axial zigzag grooves and side grooves outline multiple beads on the outer surface of the applying member. More particularly, the overall arrangement of the beads, the axial zigzag grooves, and the side grooves make the beads appear to be zigzagging and overlapping like in a braid.

According to an aspect of the present disclosure, the length and depth of at least one of the axial zigzag and side grooves varies along at least a portion of the length of the applying member. However, in other embodiments, the depth of the axial zigzag and side grooves may not vary all along the length of the applying member.

According to yet another aspect of the present disclosure, the left side beads alternate with the right side beads in the axial direction of the applying member. The left side beads are inclined in the substantially same directions in almost parallel with each other. Similarly, the right side beads are inclined in the substantially same directions in almost parallel with each other. As used herein, the term "substantially" is known by those skilled in the art. Alternatively, the term "substantially" means +/−15 degrees.

According to an aspect of the present disclosure, each of the left and the right side beads has a greatest length ranging between 3.5-6.5 mm. In a preferred embodiment, the applying member may include a partial bead at a proximal end thereof. The partial bead has at least two opposing surfaces provided at the front face and the rear face. The two opposing surfaces of the partial bead can be convex or concave.

According to yet another aspect of the present disclosure, each of the beads of the applying member is joined to at least two of the adjacent beads. At least one of the axial zigzag grooves and side grooves exists between or at the interface of the two adjacent beads on the outer surface of the applying member.

According to yet another aspect of the present disclosure, the applying member is asymmetric about the central axis. Further, the beads are substantially non-spherical and of non-uniform sizes and shapes. A central axis of each of the beads intersects at the central longitudinal axis of the applying member in an inclined manner.

According to an aspect of the present disclosure, the number of beads of the applying member may vary from 4-10, preferably 6-8.

According to yet another aspect of the present disclosure, one of the two adjacent beads near the distal end of the applying member has an extended portion that extends beyond a distal end of the other of the two adjacent beads of the applying member. More particularly, the applying member includes a distal-most bead having an extended portion that extends beyond the distal ends of the rest of the beads of the applying member. The extended portion forms a tip that ensures a precise application on the application surface and can serve the massage function. More particularly, the extended portion is like a spatula with a convex surface and an opposing substantially flat surface. The flat surface of the extended portion of the distal-most bead faces the central longitudinal axis of the applying member. The length of the extended portion is the difference between the length of the left side face and the length of the right face. The length of the left face is between 10-20 mm and the length of the right face is between 8 to 18 mm. The length of the extended portion of the distal-most bead is between 1.5 mm to 4 mm.

According to an aspect of the present disclosure, the flat surface of the extended portion of the distal-most bead forms an obtuse angle with an outer surface of the adjacent distal bead. The obtuse angle may range between 100-120 degrees.

In an embodiment, the flat surface of the extended portion of the distal-most bead may have a cavity for improved retention of the cosmetic product.

According to an aspect of the present disclosure, the width of the applying member increases and decreases many times while moving from the proximal end towards the distal end, and said variation in the width is selected from the range between 5 to 10 mm. The thickness of the applying member also varies along the length of the applying member and is selected from a range between 3-6 mm.

According to an aspect of the present disclosure, the applicator head according to the present disclosure is configured to be part of a cosmetic package. The cosmetic package comprises a receptacle for holding a cosmetic product and a cosmetic applicator. The cosmetic applicator comprises the applicator head, a stem, and a cap. The cap of the cosmetic applicator has threads that can be screwed onto threads formed on a neck of the receptacle. The applicator head is retained at a distal end of the stem for applying the product; and the cap at a proximal end of the stem.

In general, the use of the terms "distal" and "proximal" herein is supposed to mean that the distal is the end facing towards the inside of the storage receptacle, whereas the proximal is the end facing towards the removal opening of the receptacle.

According to yet another aspect of the present disclosure, the distal end of the stem includes an interior longitudinal cavity for receiving and retaining the applicator head. The neck of the receptacle has a wiper for wiping off excess product from the cosmetic applicator. The wiper serves to wipe off not only the excess cosmetic product attached to the applying member but also the cosmetic product attached to the stem.

Further, the applicator head of the cosmetic applicator may be used to apply the product including a cosmetic or care product. The cosmetic or care product includes viscous cosmetics, mascara, eyebrow powder, lip gloss, hair color, skincare, under-eye cosmetics, pharmaceutical, and like products.

According to yet another aspect of the present disclosure, the shank member is configured to be received and retained within the longitudinal cavity of the stem.

According to an embodiment, the shank member and the applying member are integral, however in alternate embodiments that may be two separate parts.

According to an aspect of the present disclosure, the applying member extends longitudinally from the proximal end towards the distal end of the applying member. The shank member is connected to applying member by an intermediate section that is conical. The intermediate section connects the applying member with the shank member. The circumference of the intermediate section decreases while moving towards the applying member from the shank portion of the applicator head.

In alternate embodiments, the applicator head may not include the intermediate section between the applying member and the shank portion.

According to an aspect of the present disclosure, an outer surface of the applying member may be flocked with fibers. Briefly, the fibers for flocking which may be of any commonly used material, such as nylon, polyester, or any natural fiber are applied with an adhesive, such as an epoxy, to the surface to be flocked. The flocking finish to the outer surface of the applying member may be achieved by an appropriately chosen known technique, such as electrostatic flocking.

According to an alternate embodiment of the present disclosure, the applying member may or may not be flocked or partially flocked.

According to an aspect of the present disclosure, the shank member of the applicator head may be secured to the stem, for example, by a press-fit, snap-fit, adhesive, and/or engagement by one or more engagement features.

According to an embodiment of the present disclosure, at least a part of the applicator head can be made by molding, e.g. by injection-molding, e.g. in a material selected from the following list: thermoplastic materials; elastomers; thermoplastic elastomers; thermoplastic elastomer polyester such as HYTREL®, for example; nitrile rubber; silicone rubber; ethylene-propylene terpolymer rubber (EPDM); styrene-ethylene-butylene-styrene (SEBS); styrene-isoprene-styrene (SIS); polyurethane (PU); ethyl vinyl acetate (EVA); polyvinyl chloride (PVC); polyethylene (PE); polyethylene terephthalate (PET); polypropylene (PP); this list not being limiting.

According to the first embodiment, the receptacle and the cap may be made of a rigid material like glass, metal, hard plastic, or any other material known in the art. However, in alternate embodiments, the receptacle and the cap may be made of a flexible material like flexible polymeric material or any other material known in the art.

According to the first embodiment of the present disclosure, the stem presents a circular cross-section, but it is not beyond the ambit of the present disclosure for this to be otherwise, in particular when the cross-section of the stem is oval, elliptical, or polygonal, e.g. square, triangular or rectangular. The stem can be solid as shown, or, in a variant, it could be hollow.

When the stem is not of circular cross-section, the cap can be fastened on the receptacle by snap-fastening or by some other means, without turning relative to said receptacle. The wiper can thus present a non-circular wiper orifice of the section that is complementary to the section of the stem.

According to an embodiment of the present disclosure, the applicator head can be made, at least in part, from a material that is more flexible than the material from which the stem is made.

According to the present disclosure, the stem can have a longitudinal axis that is rectilinear as shown. However, in alternate embodiments, it could be curved.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein.

DETAILED DESCRIPTION

Figure 1A:
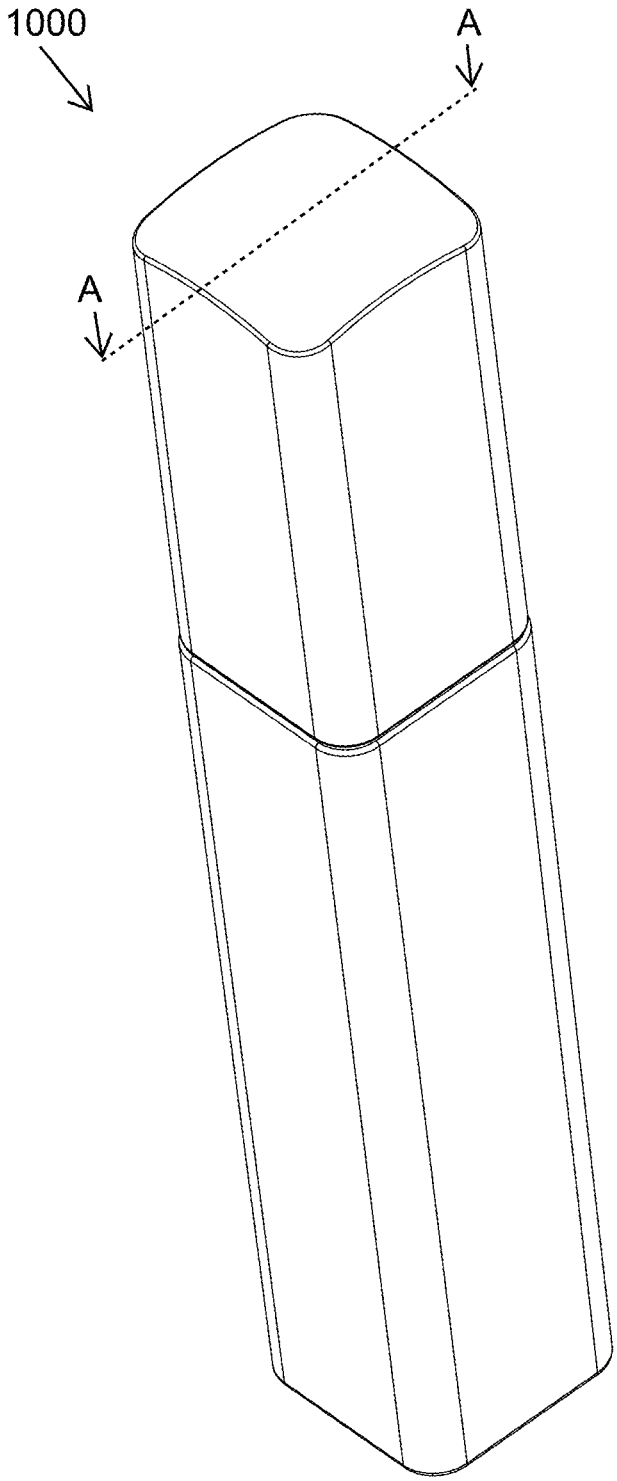
FIG. 1A illustrates a perspective view of a cosmetic package according to a first embodiment of the present disclosure.

As shown throughout the drawings, like reference numerals designate like or corresponding parts. While illustrative embodiments of the present disclosure have been described and illustrated above, it should be understood that these are exemplary of the disclosure and are not to be considered as limiting. Additions, deletions, substitutions, and other modifications can be made without departing from the spirit or scope of the present disclosure. Accordingly, the present disclosure is not to be considered limited by the foregoing description.

Throughout this specification, the terms "comprise," "comprises," "comprising" and the like, shall consistently mean that a collection of objects is not limited to those objects specifically recited.

Figure 1B:
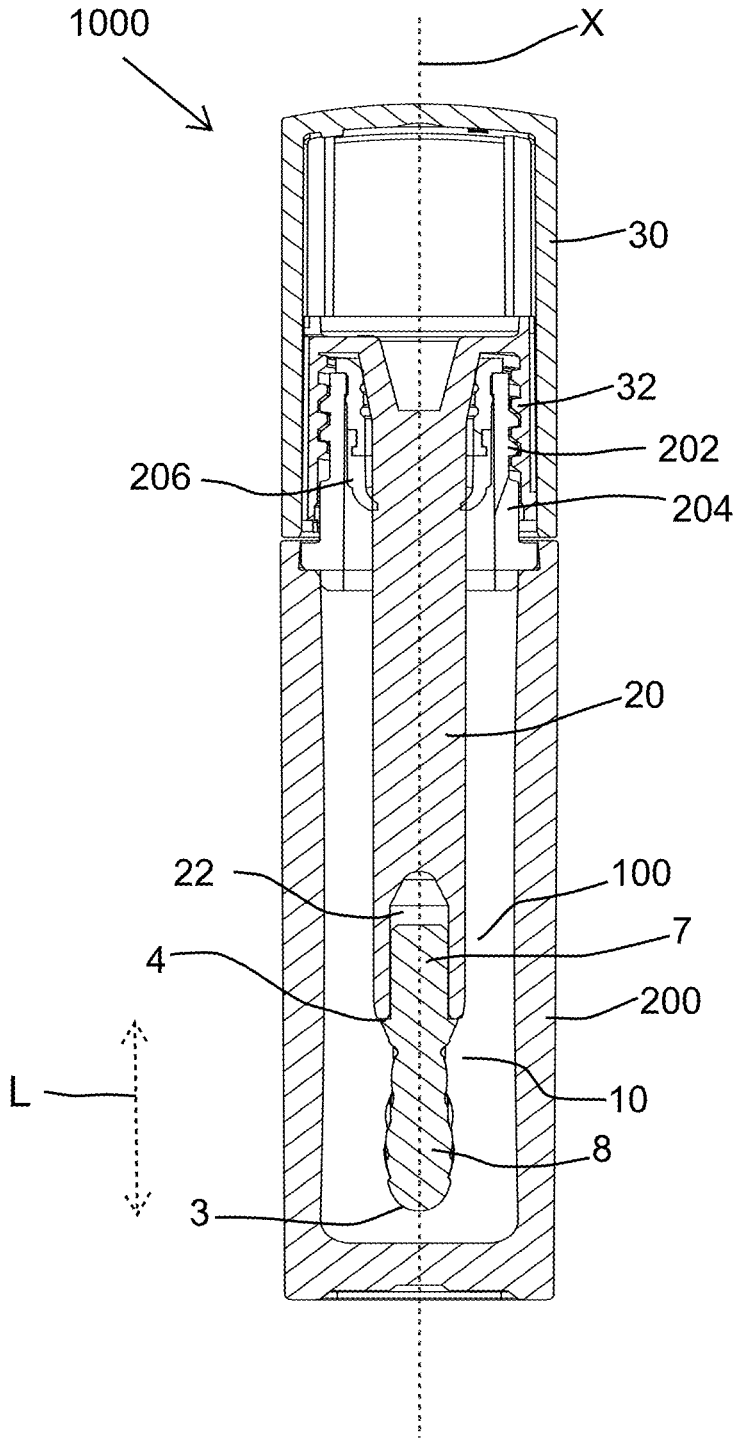
FIG. 1B illustrates a longitudinal cross-sectional view taken along a line AA of the cosmetic package shown in FIG. 1A.
Figure 2:
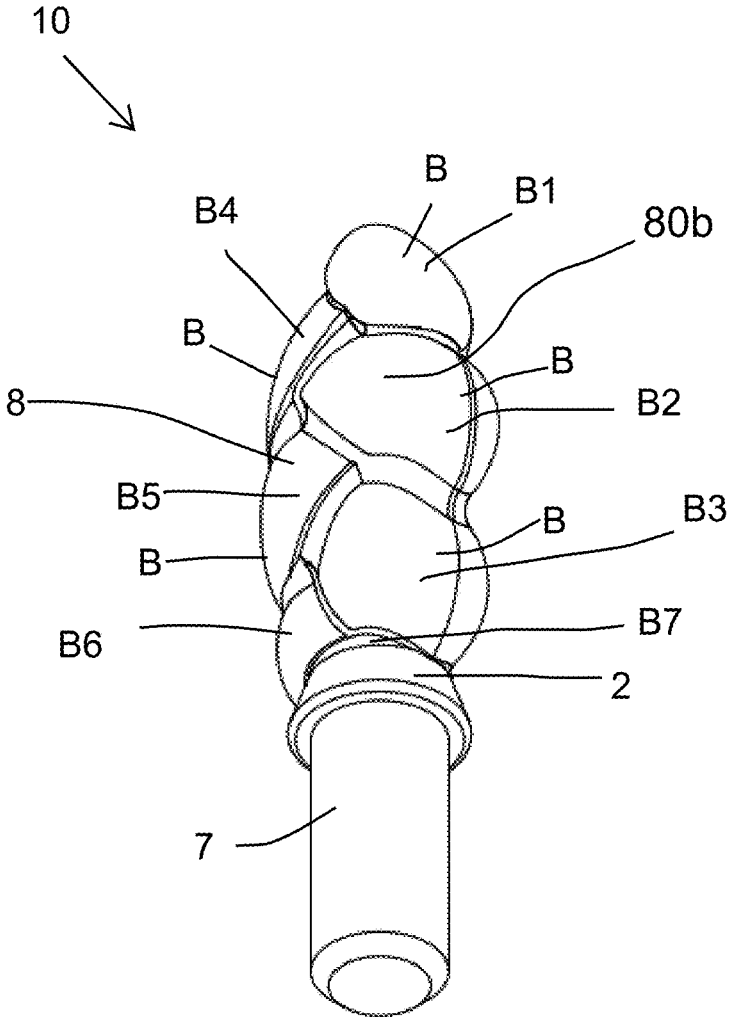
FIG. 2 illustrates a rear perspective view of an applicator head of the cosmetic package of FIG. 1B.

FIG. 1 illustrates a longitudinal sectional view of a cosmetic package 1000 according to present disclosure. The cosmetic package 1000 comprises a receptacle 200 for holding a cosmetic product (not shown) and a cosmetic applicator 100. The cosmetic applicator 100 comprises an applicator head 10, a stem 20, and a cap 30, see FIG. 1. The cap 30 of the cosmetic applicator 100 has threads 32 that can be screwed onto threads 202, formed on a neck 204 of the receptacle 200. The applicator head 10 is retained at a distal end of the stem 20 for applying the product; and the cap 30 at a proximal end of the stem 20.

In general, the use of the terms "distal" and "proximal" herein is supposed to mean that the distal is the end facing towards the inside of the storage receptacle 200, whereas the proximal is the end facing towards the removal opening of the receptacle 200.

As seen in FIG. 1, the distal end of the stem 20 includes an interior longitudinal cavity 22 for receiving and retaining the applicator head 10. Inserted in the neck 204 of the receptacle 200 is a wiper 206 for wiping off excess product from the cosmetic applicator 100.

Further, the applicator head 10 of cosmetic applicator 100 may be used to apply the product including a cosmetic or care product. The cosmetic or care product includes viscous cosmetics, mascara, eyebrow powder, lip gloss, hair color, skincare, under-eye cosmetics, pharmaceutical, and like products.

As shown in FIGS. 1-6, the applicator head 10 comprises an applying member 8 at its distal portion and a shank member 7 at its proximal portion. The shank member 7 is configured to be received and retained within the longitudinal cavity 22 of the stem 20 (see FIG. 1).

In the present embodiment, the shank member 7 and the applying member 8 are integral, however in alternate embodiments that may be two separate parts. The applying member 8 is designed to apply the product to a target surface.

Figure 3:
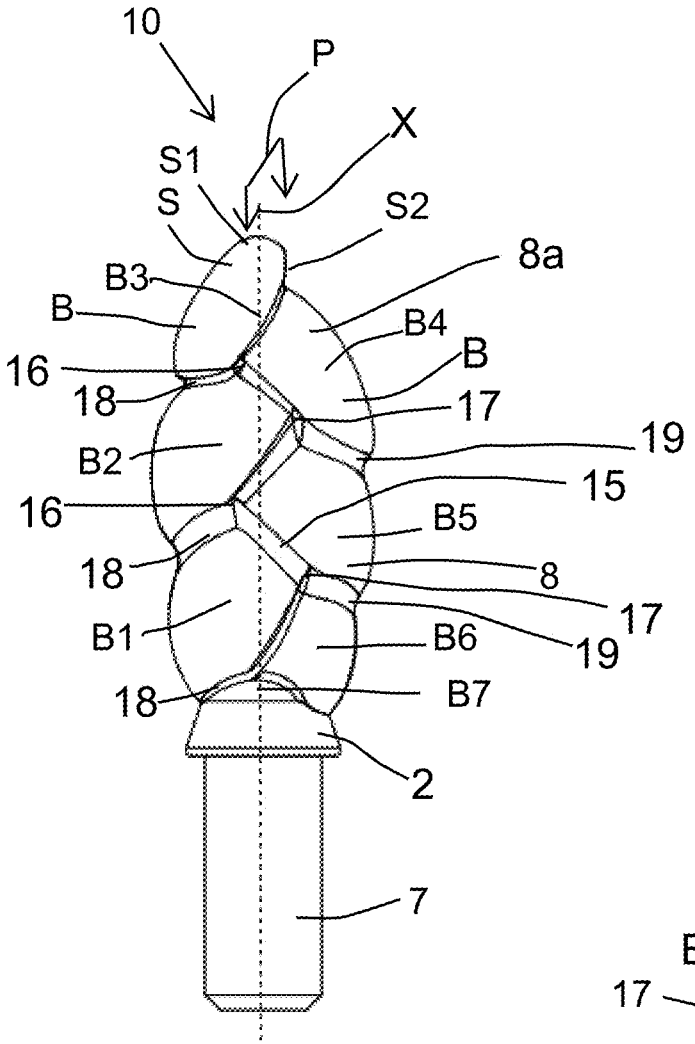
FIG. 3 illustrates a front view of the applicator head of the cosmetic package of FIG. 1.
Figure 4:
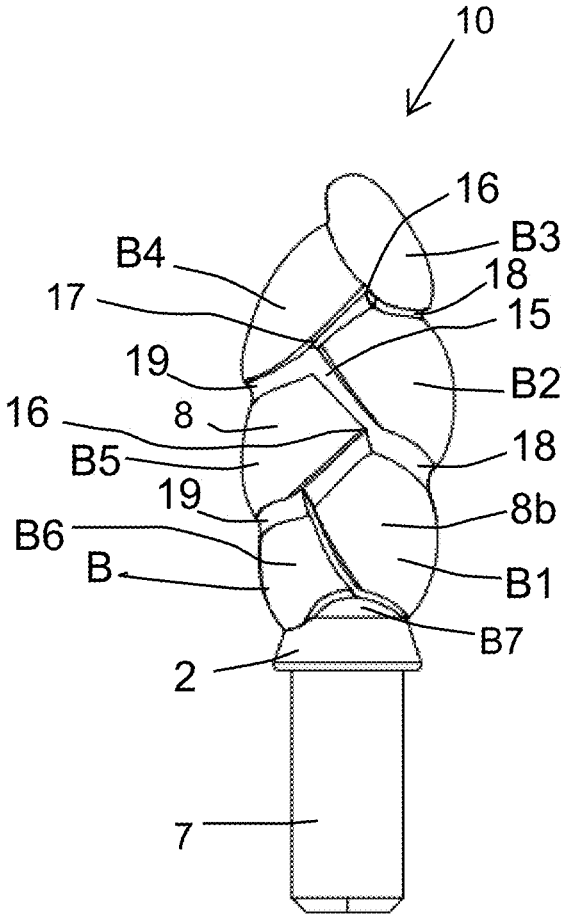
FIG. 4 illustrates a back view of the applicator head of the cosmetic package of FIG. 1.
Figure 5:
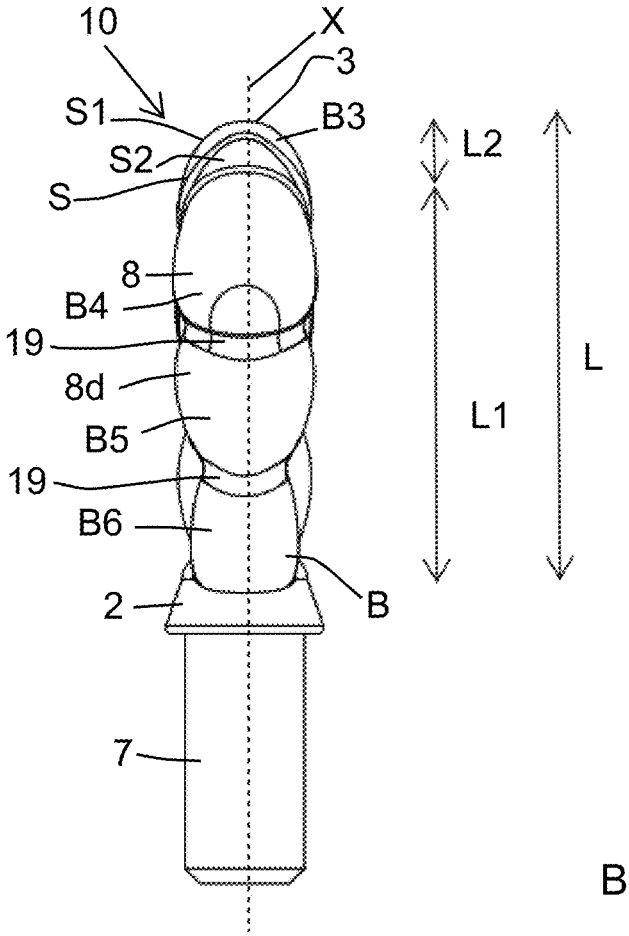
FIG. 5 illustrates a right side view of the applicator head of FIG. 3.
Figure 6:
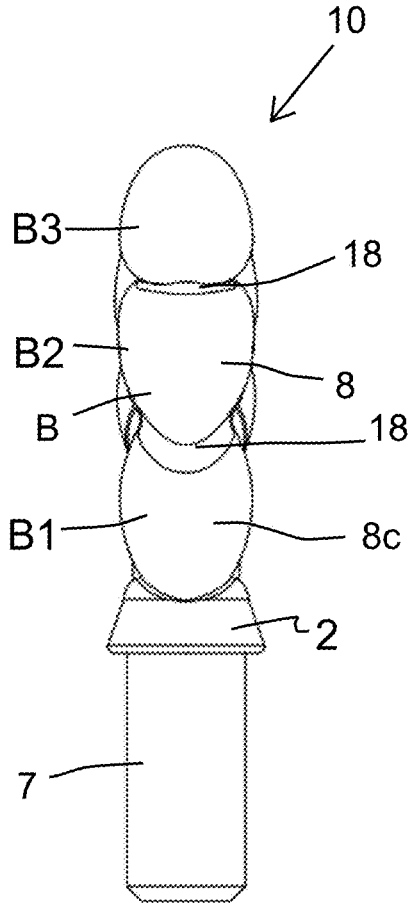
FIG. 6 illustrates a left side view of the applicator head of FIG. 3.

The applicator head 10 and the applying member 8 are elongated along a central longitudinal axis X of the cosmetic applicator 100 (refer to FIG. 1). The applying member 8 has a distal end 3 and a proximal end 4 that are opposite relative to the axis X are separated, along said axis X, by a distance marked L in FIG. 1. Wherein, said distance L defines the length of the applying member 8 and is, for example, between 14 mm and 20 mm. As seen in FIGS. 3 and 4, the width of the applying member 8 increases and decreases many times while moving from the proximal end 4 towards the distal end 3, and said variation in the width is selected from the range between 5 to 10 mm. As seen in FIGS. 5 and 6, the thickness of the applying member 8 also varies along the length of the applying member 8 and is selected from a range between 3-6 mm.

Referring to FIGS. 2-5, the applying member 8 extends longitudinally from the proximal end 4 towards the distal end 3 of the applying member 8. The shank member 7 is connected to applying member 8 by an intermediate section 2 that is conical. The intermediate section 2 connects the applying member 8 with the shank member 7. The circumference of the intermediate section 2 decreases while moving towards the applying member 8 from the shank portion 7 of the applicator head 10.

In alternate embodiments, the applicator head 10 may not include the intermediate section 2 between the applying member 8 and the shank portion 7.

As illustrated in FIGS. 2-6, the applying member 8 includes a front face 8*a*, a rear face 8*b* opposing the front face 8*a*, a left face 8*c*, and a right face 8*d* opposing the left face 8*c*. The left face 8*c* and the right face 8*d* have wavy curved surfaces along the length of the applying member 8.

An outer surface of the applying member 8 is contoured with multiple beads B to resemble a braid. The multiple beads B are contoured on the applying member 8 and arranged in a manner to form a braid-like pattern on the front face 8*a* and the rear face 8*b* of the applying member 8, refer to FIGS. 3 and 4. Particularly, the pattern formed by the arrangement of the multiple beads B resembles a braid pattern formed by interlacing two or more strands. In the exemplary embodiment, the applying member 8 includes six beads B1, B2, B3, B4, B5, and B6. Referring to FIGS. 3-6, the beads B1, B2, B3, B4, B5 and B6 are convex structure with convex outer surfaces. Further, each of the six beads B1-B6 is non-spherical and is inclined with respect to the center longitudinal axis X of the applying member 8. When seen from the front face 8*a* of the applying member 8, the applying member 8 includes at least two left side beads, preferably, three left side beads B1, B2, B3, and at least two right side beads, preferably, three right side beads B4, B5, and B6 on the front face 8*a* of the applying member 8. Each of the left side beads B1, B2, and B3 extends to the front face 8*a*, the rear face 8*b*, and the left face 8*c*. Similarly, each of the right side beads B4, B5, B6 extends to the front face 8*a*, the rear face 8*b*, and the right face 8*d*.

As seen in FIG. 6, the left face 8*c* of the applying member 8 is defined by portions of the outer surfaces of the three beads B1, B2, and B3. Referring to FIG. 5, the right face 8*d* of the applying member 8 is defined by portions of the outer surfaces of the three beads B4, B5, and B6.

The applying member 8 when seen from the front face 8*a* has the three left side beads B1, B2, and B3 that incline upward from a left to a right direction and toward the center longitudinal axis of the applying member 8. The applying member 8 when seen from the front face 8*a* has the three right side beads B4, B5, and B6 that incline upward from the right to the left direction and toward the center longitudinal axis X of the applying member 8. Each of the beads B has an elongated structure having a major axis and a minor axis.

Referring to FIGS. 3 and 4, the applying member 8 has an axial zigzag groove 15 at least on one of the front face 8*a* and the back face 8*b*. Preferably, an axial zigzag groove 15 extends along the applying member 8 on both the front face 8*a* and the rear face 8*b* of the applying member 8. The axial zigzag groove 15 is located at the middle position of each of the front face 8*a* and the rear face 8*b*. Each of the limbs of the axial zigzag groove 15 is inclined at only a very small angle with respect to the central longitudinal axis X. Each of the axial zigzag grooves 15 has vertices 16 formed by the limbs on one side of the longitudinal axis X of the applying member 8, and the vertices 17 formed by the limbs on the other side of the longitudinal axis X of the applying member 8.

Further, the applying member 8 includes multiple side grooves 18, 19 disposed on each side of the axial zigzag groove 15. The multiple side grooves 18, 19 extends from the main axial zigzag groove 15 of the front face 8*a* to the axial zigzag groove 15 of the rear face 8*b* of the applying member 8, refer FIGS. 3-6.

According to yet another aspect of the present disclosure, a plane P passing through and along the central longitudinal axis of the applying member 8 orthogonally to the front face 8*a* and the rear face 8*b* divides the applying member 8 asymmetrically into a left side part and a right side part when seen from the front face 8*a* of the applying member 8, see FIG. 3. The vertices 16 of the axial zigzag grooves 15*a* that lie on the left side of the central longitudinal axis X of the applying member 8 are left vertices 16 and those that lie on the right side of the central longitudinal axis X of the applying member 8 are right vertices 17. Similarly, the side grooves 18 that extend on the left side part of the applying member 8 are left side grooves 18. The side grooves 19 that extend on the right side of the applying member 8 are right side grooves 19.

The left and right side grooves 18, 19 intersect with the axial zigzag grooves 15 at the zigzag vertices 16, 17. Each side groove 18, 19 connects one of the vertices 16, 17 of the axial zigzag groove 15 on the front face 8*a* to a corresponding vertex 16,17 of the axial zigzag groove 15 on the rear face 8*b*. More particularly, each side groove 18, 19 extends in a peripheral direction from one of the vertices 16, 17 of the axial zigzag groove 15 from the front face 8*a* to a corresponding vertex 16, 17 of the axial zigzag groove 15 of the rear face 8*b*. Thereby, the applying member 8 is divided into multiple beads B between the axial zigzag grooves 15 and the side grooves 18, 19. In other words, the side grooves 18, 19, and the axial zigzag grooves 15 divide the applying member 8 into a structure of connected beads B.

The left side grooves 18 extend from left vertices 16 to corresponding left vertices 16 on the rear face 8*b*. The right side grooves 19 extend from right vertices 17 of the front face 8*a* to corresponding right vertices 17 on the rear face 8*b*. The left side grooves 18 and the right side grooves 19 are inclined in opposite directions.

Referring to FIG. 3, the axial zigzag groove 15 and the left side grooves 18 divide the applying member 8 into a row of axially arranged left side beads B1, B2, and B3. Similarly, the axial zigzag groove 15, and the right side grooves 19 divide the applying member 8 into a row of axially arranged right side beads B4, B5, and B6.

The left and right side grooves 18, 19 function to retain some amount of the cosmetic product therein in order to improve the product load on the applying member 8. More particularly, the axial and side grooves 15, 18, and 19 of the applying member 8 that are formed between the beads B offer a high retention volume of the cosmetic product. Further, side grooves 18, and 19 interconnect the two axial zigzag grooves 15 forming channels that extend from front face 8*a* to rear face 8*b* of the applying member 8.

The side grooves 18 and 19 are inclined at an angle selected from a range of 85 to 65 degrees with respect to the longitudinal axis X of the applying member 8.

As seen in FIGS. 3 and 4, the left side beads B1, B2, and B3 alternate with the right side beads B4, B5, B6 in the axial direction of the applying member 8. The left side beads B1, B2, and B3 are inclined in the substantially same directions in almost parallel with each other. Similarly, the right side beads B4, B5, and B6 are inclined in the substantially same directions in almost parallel with each other.

According to an aspect of the present disclosure, each of the left and the right side beads B1, B2, B3, B4, B5, and B6 has a greatest length ranging between 3.5-6.5 mm. In this embodiment, as shown in FIGS. 3-4, the applying member 8 includes a partial bead B7 at a proximal end thereof connected to the intermediate section 2. The partial bead B7 has at least two opposing surfaces provided at the front face 8*a* and the rear face 8*b*. The two opposing surfaces of the partial bead B7 can be convex or concave.

The applying member 8 is asymmetric about the central longitudinal axis X. Further, as shown in FIGS. 3-6, the beads B1-B6 are substantially non-spherical and of non-uniform sizes and shapes. A central axis of each of the beads B intersects at the central longitudinal axis X of the applying member 8 in an inclined manner.

As seen in FIGS. 3-4, each of the beads B of the applying member 8 is joined to at least two of the adjacent beads B. At least one of the axial zigzag grooves 15 and side grooves 18 and 19 exists between two adjacent beads B on the outer surface of the applying member 8.

The axial zigzag and side grooves 15, 18, and 19 of the applying member 8 are interconnected on the outer surface of the applying member 8. Thus, the axial zigzag and side grooves 15, 18, and 19 outline multiple beads B on the outer surface of the applying member 8.

The overall arrangement of the beads B, the axial zigzag and side grooves 15, 18, and 19 make beads B appears to be zigzagging and overlapping like in a braid.

According to an aspect of the present disclosure, the length and depth of at least one of the axial zigzag and side grooves 15, 18, and 19 varies along at least a portion of the length of the applying member 8. However, in other embodiments, the depth of the axial zigzag and side grooves 15, 18, and 19 may not vary all along the length of the applying member 8.

According to an aspect of the present disclosure, the beads B are substantially non-spherical and they vary in size and shape across the entire length of the applying member 8. According to an aspect of the present disclosure, the number of beads B of the applying member may vary from 4-10, preferably 6-8.

Referring to FIGS. 3 and 5, a portion of one of the two adjacent beads B3, B4 near the distal end 3 of the applying member 8 extends beyond a distal end of the other of the two adjacent beads B3, B4 of the applying member 8. More particularly, the applying member includes a distal-most bead B3 that extends beyond the distal ends of the rest of the beads B of the applying member 8. At least a portion of a lateral side of the distal-most bead B3 is connected to a distal adjacent bead B4 near the distal end 3 of the applying member 8. More particularly, the bead B3 extends beyond a distal end of the adjacent bead B4 of the applying member 8. Thus, the distal end 3 of the applying member 8 is defined by a distal end of the bead B3.

Referring to FIGS. 3 and 5, the bead B3 has an extended portion S that extends axially beyond the rest of the beads B of the applying member 8. The extended portion S forms a tip that ensures a precise application on the application surface and can serve the massage function. More particularly, the extended portion S is like a spatula with a convex surface S1 and an opposing substantially flat surface S2. The flat surface S2 of the extended portion S of the bead B3 faces the central longitudinal axis X of the applying member 8. The length L2 of the extended portion S is the difference between the length L of the left face 8*c* and the length L of the right face 8*d*, i.e. L2=L−L1. The length L of left face 8*c* is between 10-20 mm and the length L2 of the right face 8*d* is between 8 to 18 mm. The length L2 of the extended portion S of the bead B3 is between 1.5 mm to 4 mm.

According to an aspect of the present disclosure, the flat surface S2 of the extended portion S of the distal-most bead B3 forms an obtuse angle with an outer surface of the adjacent bead B4. The obtuse angle may range between 100-120 degrees.

In alternate embodiment, the flat surface S2 of the extended portion S of the distal-most bead B3 may have a cavity for improved retention of the cosmetic product.

Figure 7:
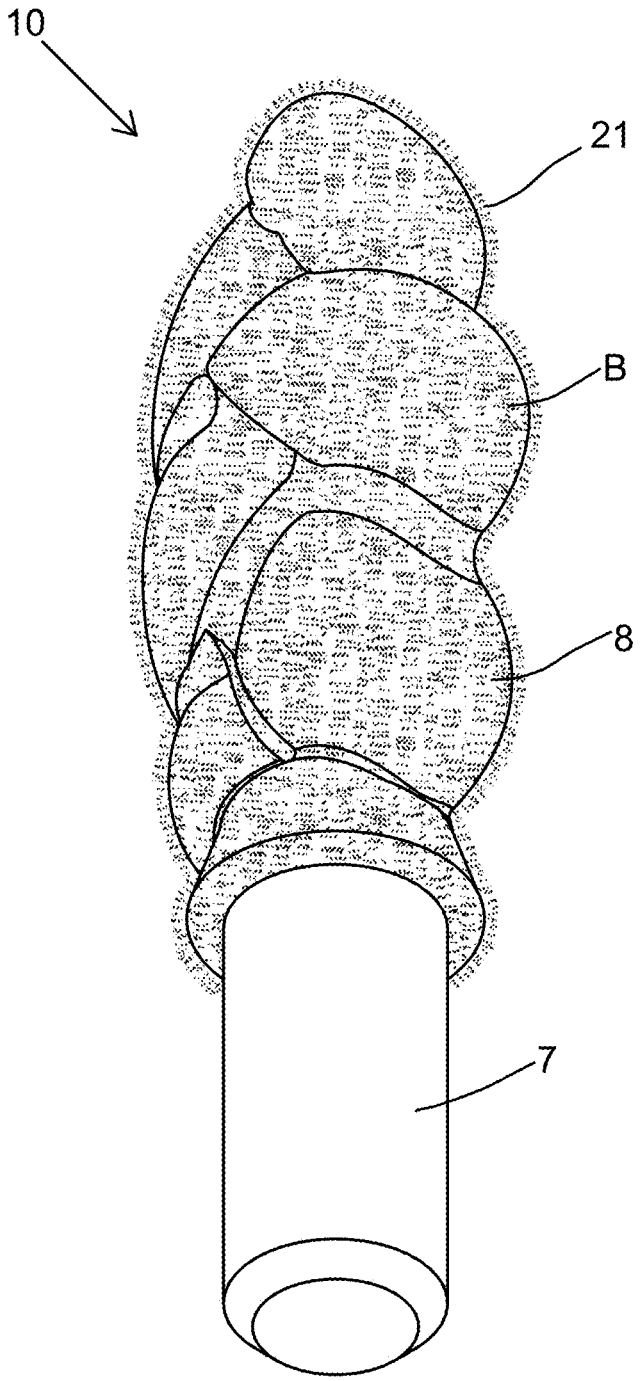
FIG. 7 illustrates a perspective view of the applicator head of FIG. 2 with flocking on an outer surface of an applying member thereof.

According to an aspect of the present disclosure, an outer surface of the applying member 8 may be flocked with fibers 21, as seen in FIG. 7. Briefly, the fibers 21 for flocking which may be of any commonly used material, such as nylon, polyester, or any natural fiber are applied with an adhesive, such as an epoxy, to the surface to be flocked. The flocking finish to the outer surface of the applying member 8 may be achieved by an appropriately chosen known technique, such as electrostatic flocking.

According to an alternate embodiment of the present disclosure, the applying member 8 may or may not be flocked or partially flocked.

According to an aspect of the present disclosure, the shank member 7 of the applicator head 10 may be secured to the stem 20, for example, a press-fit, snap-fit, adhesive, and/or engagement by one or more engagement features.

According to an embodiment of the present disclosure, at least a part of the applicator head 10 can be made by molding, e.g. by injection-molding, e.g. in a material selected from the following list: thermoplastic materials; elastomers; thermoplastic elastomers; thermoplastic elastomer polyester such as HYTREL®, for example: nitrile rubber; silicone rubber; ethylene-propylene terpolymer rubber (EPDM); styrene-ethylene-butylene-styrene (SEBS); styrene-isoprene-styrene (SIS); polyurethane (PU); ethyl vinyl acetate (EVA); polyvinyl chloride (PVC); polyethylene (PE); polyethylene terephthalate (PET); polypropylene (PP); this list not being limiting.

In the first embodiment, the wiper 206 serves to wipe off not only the excess cosmetic product attached to the applying member 8 but also the cosmetic product attached to the stem 20.

According to the first embodiment, the receptacle 200 and the cap 30 may be made of a rigid material like glass, metal, hard plastic, or any other material known in the art. However, in alternate embodiments, the receptacle 200 and the cap 30 may be made of a flexible material like flexible polymeric material or any other material known in the art.

According to the first embodiment of the present disclosure, the stem 20 presents a circular cross-section, but it is not beyond the ambit of the present disclosure for this to be otherwise, in particular when the cross-section of the stem 20 is oval, elliptical, or polygonal, e.g. square, triangular or rectangular. The stem 20 can be solid as shown, or, in a variant, it could be hollow.

When the stem 20 is not of circular cross-section, the cap 30 can be fastened on the receptacle 200 by snap-fastening or by some other means, without turning relative to said receptacle 200. The wiper 206 can thus present a non-circular wiper orifice 215 of the section that is complementary to the section of the stem 20.

According to an embodiment of the present disclosure, the applicator head 10 can be made, at least in part, from a material that is more flexible than the material from which the stem 20 is made.

According to the present disclosure, the stem 20 can have a longitudinal axis that is rectilinear as shown. However, in alternate embodiments, it could be curved.

The present disclosure is not limited to, the broadest in accordance with the basic idea disclosed herein. It should be interpreted as having a range. Skilled artisans may implement the pattern of the non-timely manner by combining, replacement of the disclosed embodiments shape, this would also do not depart from the scope of the invention. In addition, those skilled in the art may readily change or modifications to the disclosed embodiments, based on the present specification, such changes or modifications also belong to the scope of the present disclosure will be apparent.

What is claimed is:

1. An applicator head for applying a cosmetic or a care product, the applicator head comprises:

an applying member elongated along a central longitudinal axis;

a shank member at a proximal end of the applying member;

wherein the applying member includes a front face, a rear face opposing the front face, a left face, and a right face opposing the left face;

wherein an axial zigzag groove extends along the applying member on each of the front face and the rear face of the applying member;

wherein the axial zigzag groove is located at a middle position of each of the front face and the rear face;

wherein the axial zigzag groove has vertices on both sides of the central longitudinal axis of the applying member on each of the front face and the rear face;

wherein there are side grooves on an outer surface of the applying member, the side grooves are disposed on each side of the axial zigzag groove;

wherein the axial zigzag grooves and the side grooves are formed on the outer surface of the applying member:

wherein each of the side grooves extends laterally from one of the vertices of the axial zigzag groove of the front face to the corresponding vertices of the axial zigzag groove on the rear face of the applying member and vice-versa;

wherein the side grooves interconnect the axial zigzag grooves forming channels that extend from the front face to the rear face of the applying member; and wherein the side grooves and the axial zigzag grooves outline multiple beads on the outer surface of the applying member;

wherein the multiple beads are defined by the side grooves and the axial zigzag grooves;

wherein the multiple beads have convex outer surfaces;

wherein, when the applying member is viewed from the front face, the multiple beads comprise three left-side beads located generally on a left side of the central longitudinal axis and three right-side beads located generally on a right side of the central longitudinal axis;

wherein each of the three left-side beads extends on the front face, the left face, and the rear face, and each of the three right-side beads extends on the front face, the right face, and the rear face;

wherein, when seen from the front face of the applying member and proceeding from a proximal end toward a distal end of the applying member, the three left side beads incline upward toward the central longitudinal axis of the applying member, and the three right side beads incline upward toward the central longitudinal axis of the applying member;

wherein each of the three left-side beads extend partially across the central longitudinal axis on the front face as well as on the rear face, and similarly each of the three right-side beads extend partially across the central longitudinal axis on the front face as well as on the rear face;

wherein the left side and right side beads are arranged in alternate fashion to define alternating beads that traverse the central longitudinal axis twice, once on the front face and once on the rear face; and wherein the axial zigzag grooves and the side grooves outline on the outer surface of the applying member, an axial row of the three left side beads and an axial row of the three right side beads.

2. The applicator head according to claim 1, wherein the side grooves are inclined with respect to the central longitudinal axis of the applying member; and wherein the side grooves on either side of the central longitudinal axis are inclined in opposite directions.

3. The applicator head according to claim 1, wherein the left face of the applying member is defined by portions of the outer surfaces of the three left side beads; and wherein the right face of the applying member is defined by portions of the outer surfaces of the three right side beads.

4. The applicator head according to claim 1, wherein the three left side beads alternate with the three right side beads in the axial direction of the applying member; wherein the three left side beads are inclined in the substantially same direction parallel with each other; wherein the three right side beads are inclined in the substantially same direction parallel with each other; and wherein the arrangement of beads and the axial zigzag grooves, and the side grooves make the beads appear to be zigzagging and overlapping like in a braid.

5. The applicator head according to claim 1, wherein the left side beads include a partial bead on the front face and the right side beads include a partial bead on the rear face; wherein the partial beads are near a proximal end of the applying member; and wherein surfaces of the partial beads are convex.

6. The applicator head according to claim 1, wherein each of the three left side beads and the three right side beads has a greatest length ranging between 3.5-6.5 mm.

7. The applicator head according to claim 1, wherein the multiple beads are non-spherical and of non-uniform sizes and shapes; and wherein the number of multiple beads of the applying member range from 6 to 10 beads.

8. The applicator head according to claim 1, wherein the three left side beads includes a distal-most bead having an extended portion; wherein the extended portion extends beyond the distal ends of the rest of the beads of the applying member; and wherein the extended portion has a convex surface facing the left face of the applying member and an opposing substantially flat surface facing the central longitudinal axis of the applying member.

9. The applicator head according to claim 8, wherein a length of the left face is between 10-20 mm; wherein a length of the right face is between 8 to 18 mm; and wherein the length of the extended portion of the distal-most bead is between 1.5 mm to 4 mm.

10. The applicator head according to claim 1, wherein a width of the applying member increases and decreases many times while moving from the proximal end towards a distal end of the applying member; wherein the variation in the width is selected from a range of between 5 to 10 mm; wherein a thickness of the applying member varies along a length of the applying member and is selected from a range of between 3-6 mm; and wherein the length of the applying member is between 14 mm and 20 mm.

11. The applicator head according to claim 1, wherein the applicator head is a part of a cosmetic package; wherein the cosmetic package comprises a receptacle for holding a cosmetic product and a cosmetic applicator; wherein the cosmetic applicator comprises the applicator head, a stem, and a cap; wherein the applicator head is retained at a distal end of the stem for applying the product and the cap at a proximal end of the stem.

12. An applicator head for applying a cosmetic or a care product, the applicator head comprises:

an applying member elongated along a central longitudinal axis;

wherein the applying member includes a front face, a rear face opposing the front face, a left face, and a right face opposing the left face;

wherein when seen from the front face of the applying member, the applying member includes at least two left side beads located majorly on a left side of the central longitudinal axis and extending partially across the central longitudinal axis towards the right side;

wherein when seen from the front face of the applying member, the applying member includes at least two right side beads located majorly on a right side of the central longitudinal axis; and extending partially across the central longitudinal axis towards the left side;

wherein the at least two left side beads and the at least two right side beads alternate along, and traverse, the central longitudinal axis;

wherein each of the at least two left side beads extends to the front face, the rear face, and the left face of the applying member, while traversing the central longitudinal axis at least on one of the front face and the rear face;

wherein each of the at least two right side beads extends to the front face, the rear face, and the right face of the applying member, while traversing the central longitudinal axis at least on one of the front face and the rear face;

wherein when seen from the front face of the applying member, the at least two left side beads incline upward from a left to a right direction towards the center longitudinal axis of the applying member;

wherein when seen from the front face of the applying member, the at least right side beads incline upward from the right to the left direction toward the center longitudinal axis of the applying member; and wherein each of the at least two left side beads and the at least two right side beads have a convex outer surface.

13. The applicator head as claimed in claim 12, wherein the left face of the applying member is defined by portions of the outer surfaces of the at least two left side beads; wherein the right face of the applying member is defined by portions of the outer surfaces of the at least two right side beads; wherein the at least two left side beads are inclined in the substantially same direction parallel with each other; wherein the at least two right side beads are inclined in the substantially same direction parallel with each other; and wherein the at least two left side beads and the at least two right side beads appear to be zigzagging and overlapping like in a braid.

14. The applicator head as claimed in claim 12, the at least two left side beads and the at least two right side beads have convex and non-spherical structures.

15. An applicator head for applying a cosmetic or a care product, the applicator head comprises:

an applying member elongated along a central longitudinal axis;

wherein the applying member includes a front face, a rear face opposing the front face, a left face, and a right face opposing the left face;

wherein the applying member has an axial zigzag groove extending along the applying member on at least one of the front face and the rear face of the applying member, wherein the axial zigzag groove has vertices on both sides of the central longitudinal axis of the applying member;

wherein the applying member includes side grooves disposed on each side of the axial zigzag groove;

wherein each of the side grooves extends laterally from one of the vertices of the axial zigzag groove;

wherein the axial zigzag grooves and the side grooves are formed on an outer surface of the applying member;

wherein the side grooves interconnect the axial zigzag grooves forming channels that extend from the front face to the rear face of the applying member; and wherein the side grooves and the axial zigzag grooves outline multiple beads on the outer surface of the applying member;

wherein, when the applying member is viewed from the front face, the multiple beads comprise at least two left-side beads located generally on a left side of the central longitudinal axis and at least two right-side beads located generally on a right side of the central longitudinal axis;

wherein each left-side bead extends continuously from the front face onto the left face and further onto the rear face, and each right-side bead extends continuously from the front face onto the right face and further onto the rear face;

wherein when seen from the front face of the applying member, the at least two left-side beads extend partially across the central longitudinal axis to the right side, and the right-side beads extend partially across the central longitudinal axis to the left side, thereby defining alternating beads that traverse the central longitudinal axis;

wherein each of the at least two left side beads and the at least two right side beads have a convex outer surface; and wherein the applying member includes a distal-most bead having an extended portion; and wherein the extended portion extends beyond the distal ends of the multiple beads of the applying member to form a tip of the applying member.

* * * * *